United States Patent [19]

Gross

[11] 4,286,923

[45] Sep. 1, 1981

[54] OVERLOAD PROTECTION DEVICE FOR A PROPELLER DRIVE ENGINE

[75] Inventor: Harald Gross, Heidenheim, Fed. Rep. of Germany

[73] Assignee: J. M. Voith GmbH, Heidenheim, Fed. Rep. of Germany

[21] Appl. No.: 381

[22] Filed: Dec. 29, 1978

[30] Foreign Application Priority Data

Jan. 4, 1978 [DE] Fed. Rep. of Germany ..... 2800227

[51] Int. Cl.[3] ..... B63H 1/10

[52] U.S. Cl. ..... 416/43; 416/108; 416/111

[58] Field of Search ..... 416/43, 108 A, 111 A

[56] References Cited

U.S. PATENT DOCUMENTS

| | | | |
|---|---|---|---|
| 2,432,320 | 12/1947 | Lilley | 416/43 X |
| 2,664,959 | 1/1954 | Stuart | 416/43 X |
| 2,971,583 | 2/1961 | Hansen et al. | 416/111 |
| 3,241,618 | 3/1966 | Baer | 416/108 |
| 3,603,697 | 9/1971 | Lane | 416/43 X |
| 3,915,590 | 10/1975 | Bjorknas | 416/43 |
| 4,084,537 | 4/1978 | Eichler | 416/108 X |

FOREIGN PATENT DOCUMENTS

| | | | |
|---|---|---|---|
| 1192945 | 1/1966 | Fed. Rep. of Germany | 416/43 |
| 2029995 | 2/1972 | Fed. Rep. of Germany | 416/108 |
| 851695 | 10/1960 | United Kingdom | 416/43 |

*Primary Examiner*—Everette A. Powell, Jr.

*Attorney, Agent, or Firm*—Ostrolenk, Faber, Gerb & Soffen

[57] ABSTRACT

An overload protection device for the drive engine of a propeller, wherein the pitch of the propeller blades may be adjusted: A servomotor with a piston therein and the servomotor being controlled by a control valve which is adjustable by an adjustment lever. The piston of the servomotor is connected via a push rod to the control station of the propeller. An adjustment device is associated with the control valve for adjusting the control valve in a direction to reduce the pitch thereof when drive engine overload occurs. A signal from the drive engine passes through a converter which magnifies it. The magnitude of the signal, as converted, is proportional to the loading of the drive engine. A reversing valve, controlled by the position of the control piston of the servomotor, operates a double acting piston connected with the operating rod of the control valve. Depending upon the shifting of the operating piston of the control valve, the servomotor is operated to adjust the pitch of the propeller blades.

10 Claims, 1 Drawing Figure

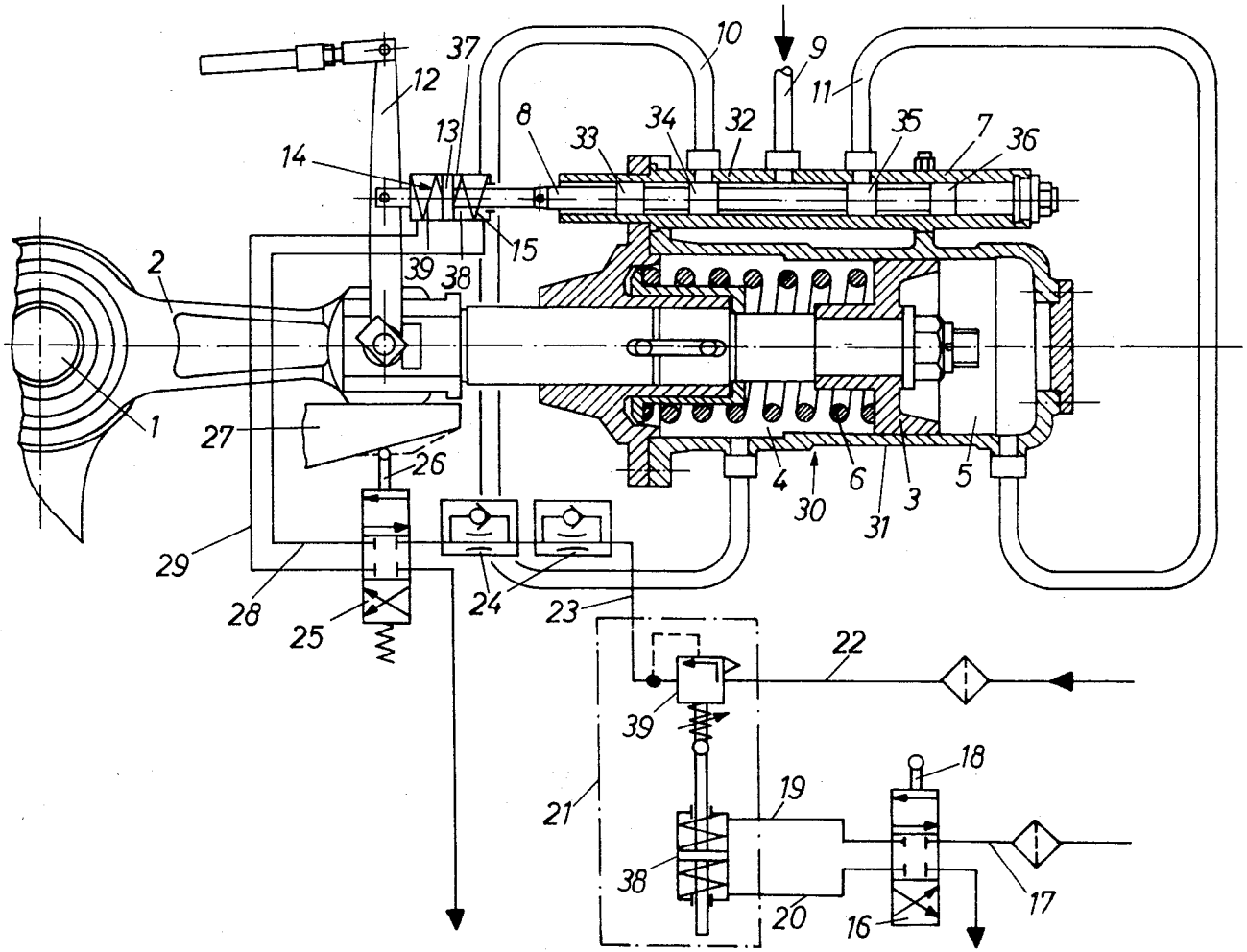
36
7
35
11
9
10
32
34
33
8
37
13
12
14
15
38
39
5
3
31
6
30
4
2
1
27
29
28
26
25
24
23
22
21
39
38
19
20
18
17
16

OVERLOAD PROTECTION DEVICE FOR A PROPELLER DRIVE ENGINE

The invention relates to an overload protection device for the drive engine of a propeller, and particularly a marine propeller, wherein the propeller is of the type with an axis of rotation generally at right angles to the forward drive direction of the vehicle or ship and which propeller is of the type permitting cyclic adjustment of the blades, in which the pitch adjustment of each blade, both in the longitudinal direction and also in the transverse direction, is effected by a servomotor which is controlled by a control valve which can be adjusted by an adjustment lever. The piston of the servomotor is connected via a push rod to the control station (control column) of the propeller.

BACKGROUND OF THE INVENTION

Propellers of this kind may have very different power requirements, according to the operating conditions. With the normal design of drive equipment, the full output of the drive engine, which is usually a supercharged diesel engine, is taken up by the propeller, when the ship is travelling freely. However, if the travel speed of the ship is impeded, for example, if something is being towed by the ship, the rated output of the engine could be greatly exceeded, owing to the propeller characteristics. It is not possible to exceed the rated output of a diesel engine due to the normal limitation of the amount of fuel injected, so that under such a circumstance, the rotational speed of the drive engine is greatly reduced.

With highly supercharged engines, such as those increasingly being used in shipping, operation of the engine at reduced speed is unacceptable, because it greatly reduces the working life of essential components. It causes air starvation and the deposition of carbon, which can cause the piston rings to seize up, for example. The cooling of the engine is also reduced unacceptably.

For this reason, until now, exceeding of the nominal rated output of an engine has been countered by a reduction in the pitch of the propeller blades. By reducing the pitch according to the loading of the drive engine, overloading and engine operation at reduced rotary speed may be avoided. Upon overloading of the drive engine with respect to its normal charging level, appropriate switching contacts were activated, which operated signalling lamps within sight of the operating personnel. When such a signal was given, the pitch of the propeller blades was reduced accordingly until the signal lamps indicated proper engine speed. This type of overloading protection was relatively effective, but it relied too much on the vigilance of an operator and was very inaccurate with regard to regulation.

SUMMARY OF THE INVENTION

An object of the present invention is therefore to provide an overload protection device for the drive engine of a propeller, and particularly a marine propeller, such as one of the Voith-Schneider (trademark) type, which works independently of any operator and which also responds quickly and precisely.

An overload protection device according to the invention for the drive engine of a propeller of the type referred to above is chacterized in that there is an adjustment device associated with a control valve for the servomotor and the device is adapted to adjust the control valve in the direction of reducing the pitch of the propeller blades when overloading of the drive engine occurs, according to a signal transmitted from the drive engine of the propeller. The magnitude of this signal is proportional to the load then on the drive engine. The pitch of the propeller blades is appropriately reduced hydraulically or pnuematically when overloading occurs according to the magnitude of the signal. This is achieved by adjustment of the control valve, which changes the position of the servomotor correspondingly. Pressure or volume flow parameters of the drive engine may be used as the signal, for example. By this means, the overload protection device of the invention functions independently of a human operator. In addition, the device of the invention not only enables the presence of overloading to be detected, but the degree of the overloading can also be established by the magnitude of the signal, so that precise pitch reduction is made possible. Oscillation between underloading and overloading is thereby largely eliminated.

One embodiment of the overload device according to the invention comprises the adjustment device having a spring-loaded, double-acting control piston, which is arranged between the adjustment lever and the control pin of the control valve. Adjustment of the control piston correspondingly moves the control pin as a function of changes in the signal, e.g. changes in pressure or flow volume of a flowing medium (a quantitative measurement). On either side of the control piston there are pressure chambers, and the control piston is held in a neutral position during normal operation by springs provided in the pressure chambers. In this way, the control piston forms a fixed connection between the adjustment lever and the control pin. "Re-setting" of the control pin only occurs when the pressure in one of the two pressure chambers changes.

As a further development of the invention, there is a reversing valve for controlling the signal arriving at the control piston from the drive engine. A control sensor of this valve slides on a wedge-shaped part connected to the push rod of the servomotor piston. The reversing valve establishes the direction in which the pressure medium is flowing to the pressure chambers of the control piston. Setting is carried out by means of the control sensor which slides on the wedge-shaped surface. It is advantageous if the wedge-shaped part has a horizontal section in the neutral zone. This ensures that the overload protection device does not respond prematurely in the middle setting range, i.e. with nil pitch, when, in view of the method of operation, there cannot be any overloading.

A converter may be provided in the flow line leading to the control piston, for amplifying the relatively weaker signal arriving from the drive engine. The converter produces a signal that corresponds to the loading of the drive engine according to the operating pressure of the propeller. It is also possible to give the converter a time constant for better co-ordination of the regulating and control circuit.

It is advantageous if valves for controlling quantities are arranged in the supply line to the control piston. This measure makes it possible to adapt the time constant of the regulating circuit.

A preferred embodiment of the invention uses the load regulating valve of a diesel engine for producing the signal. Highly supercharged diesel engines in particular generally have a load-regulating valve of known design, by means of which the loading of the machine, or the like, is regulated. According to the invention, a load regulating valve of this kind is now used to accomplish the object referred to above.

DESCRIPTION OF A PREFERRED EMBODIMENT

A preferred embodiment of an overload device according to the invention, for a propeller of the Voith-Schneider type is now described in detail, and further characteristics of the invention will be apparent from the following description taken in conjunction with the accompanying drawing, which is a somewhat schematic, part-sectional elevation of the device according to the invention.

There is a control column 1, which is arranged in a propeller housing (not shown). The column 1 sets the pitch of the propeller blades (not shown). The column 1 is connected to the piston 3 of a servomotor 30 by a connecting push rod 2. The servomotor is conventionally constructed, and includes a cylinder 31 that is divided into two pressure chambers 4 and 5 separated by a piston 3. A compression spring 6 normally urges the piston 3 to reduce chamber 5. There is a control valve 7 that includes a cyliner 32 with a control pin 8 movable axially through the cylinder 32. The cylinder 7 is mounted on a flange next to the servomotor 30. A supply line 9 and the separated distribution lines 10 and 11 distribute the pressure medium that sets the position of piston 3. Pin 8 carries cylinder seals 33, 34 near distribution line 10 and 35, 36 near distribution line 11. Shifting of pin 8 to the left in the drawing will cause communication between lines 9 and 10 and increase the pressure in chamber 4. Shifting of pin 8 to the right will cause communication between lines 9 and 11 and increase the pressure in chamber 5. The control pin 8 that projects out of the control valve 7 is initially set via an adjustment lever 12. This regulates the pressure distribution between the lines 10 and 11 for the servomotor and with it also the position of the control column 1. A second servomotor (not shown) for the propeller, and which is normally arranged at right angles to the first servomotor, can be constructed in the same way.

Between the control pin 8 and the control or adjustment lever 12, there is a control piston 13, which is located in pressure chamber cylinder 37. On both sides of piston 13, spring 14 and 15 lies in corresponding pressure chambers in cylinder 38 and 39 of cylinder 37.

A pressure signal is supplied by a load regulating valve 16 of a diesel engine that drives the propeller (not shown). The valve 16 is supplied through a pressure medium line 17 with a constant pressure of 2.5 bar, for example. There is a pin 18 in the load regulating valve 16, which is set by a regulator (not shown) in which the parameters (required rotary speed, actual rotary speed, charge pressure) are inserted and compared. This correspondingly regulates flow of pressure medium in the lines 19 and 20 which lead to a pressure converter 21. The pressure converter 21 amplifies the pressure supplied by a pressure line 22, which supplies pressure at 16 bar, for example. The lines 19, 20 communicate with a mechanical relay, shiftable piston arrangement 38 that varies the flow through the pressure line 22 at variable valve 39. From the pressure converter 21, a line 23 leads to two series connected valves 24 for regulating quantities. The outlet line from the downstream quantity regulating valve 24 leads to a reversing valve 25.

The reversing valve 25 has a control sensor 26 which is guided on a wedge-shaped part 27 that is connected to the push rod 2. As indicated with dashed lines, the wedge-shaped part 27 may alternatively be horizontal along its central zone, where the pitch of the propeller blades is nil. According to the position of the push rod 2, which regulates the position of the control sensor 26, the reversing valve 25 regulates the flow of pressure medium in the lines 28 and 29. The lines 28 and 29 lead into the respective ones 38, 39 of the two pressure chambers associated with the control piston 13, and thus bring about a displacement of the control pin 8 according to the loading of the drive engine and the pressure signal produced thereby.

Instead of a "re-setting" of the control pin 8 in the control valve 7, the connection between the adjustment lever 12 and the control pin 8 may also be rigid, as it has been hitherto, and an intermediate sleeve (not shown) which can be moved via a control piston, meay be provided over the control pin 8 instead. The control surfaces of the control valve 7 are then displaced accordingly be displacement of the intermediate sleeve.

For the control of the vessel a pitch is adjusted at the adjustment lever 12. This causes pin 8 to be shifted. Therefore, oil can flow through line 9 into line 10 and fill the pressure chamber 4. The piston 3 is displaced from the mid position, thus entraining the adjustment lever 12. This in turn brings the pin again into its neutral position and adjustment is completed. The position of piston 3 off the mid position is proportional to the position of adjustment lever 12. The function represents a mechanical-hydraulic servo system. Upon overload of the engine, and only then, will the load control valve at the engine controller respond and control, in the pressure transducer, a pressure proportional to the overload, which is directed through line 23 to reversing valve 25. In an extreme position of the piston (e.g. on the extreme right) valve 25 is connected through the wedge-shaped part 27 and the control sensor 26 to crossed passage, and the pressure in line 23 reaches the space of spring 14 in line 29. Subsequently, piston 13 is adjusted as a function of the pressure and thus of the overload, shifting piston 8 so that the pressure can get from 9 into 11. In this way piston 3 is forced into the mid position and the propeller pitch reduced. Through adjustment lever 12 control piston 8 is again returned into its neutral position and the movement of piston 3 ceases. At this reduced pitch also the overload is reduced. Upon decreases of the overload the process is reversed. If there is no overload, the piston 13 exercises no influence on the servo system.

Although the present invention has been described in connection with a preferred embodiment thereof, many variations and modifications will now become apparent to those skilled in the art. It is preferred, therefore, that the present invention be limited not by the specific disclosure herein, but only by the appended claims.

What is claimed is:

1. A device for controlling the pitch of a propeller that is driven by an engine, wherein the propeller is of the type permitting cycle adjustment of the propeller blades, the device comprising:

a connecting push rod connected to the propeller such that the shifting of the push rod in a first direction changes the pitch of the propeller in a respective first direction of pitch, and shifting of the push rod in the first opposite direction changes the pitch of the propeller in the opposite direction of pitch thereof;

a servomotor including an axially shiftable first piston connected with the push rod for moving the push rod in the first direction and the first opposite direction as the first piston shifts in a second direction and second opposite direction, respectively; the servomotor including first piston shifting means operable for shifting the first piston in its second direction and including second piston shifting means operable for shifting the first piston in its second opposite direction;

a control valve including a control pin and connected with the first and second piston shifting means such that movement of the control pin in a third direction operates the first piston shifting means and movement of the control pin in the third opposite direction operates the second piston shifting means;

an adjustment device connected with the control pin for selectively moving the control pin in the third direction and the third opposite direction thereof; the adjustment device comprising:

means for sensing the load on the engine driving the propeller to rotate and for delivering a signal dependent upon the load on that engine;

a reversing valve connected for receiving the signal from the load sensing and signal delivering means; the reversing valve also being connected with the adjustment device; the reversing valve having a first condition thereof at which the reversing valve is connected to the adjustment device for causing the adjustment device to move the control pin in the third direction and also for transmitting the load dependent signal to the adjustment device for enabling operation of the adjustment device proportional to the load dependent signal; the reversing valve having a second condition thereof at which the reversing valve is connected to the adjustment device for causing the adjustment device to move the control pin in the third opposite direction and also for transmitting the load dependent signal to the adjustment device for enabling operation of the adjustment device proportional to the load dependent signal;

a wedge pathway member connected with the servomotor first piston for moving therewith; the wedge pathway member defining a pathway that is oblique to the pathway traveled by the wedge pathway member as it moves along with the servomotor piston; the reversing valve including an operator thereof which rides along the wedge pathway of the wedge pathway member as the wedge pathway member moves with the servomotor piston with respect to the operator riding thereon; as the operator rides in a fourth direction along the wedge pathway, the operator shifts the reversing valve to the first condition thereof, as the operator rides in the opposite fourth direction along the wedge pathway, the operator shifts the reversing valve to the second condition thereof.

2. A device according to claim 1, further comprising an adjustment lever connected with the control pin for setting the position of the control pin as to the third and opposite third directions of movement thereof.

3. A device according to claim 1, wherein the load sensing and signal delivering means is adapted to send a pressure signal dependent upon the load on the engine;

the adjustment device including a double acting control piston connected with the control pin for moving the control pin as the control piston moves;

in the first condition thereof, the reversing valve transmits the pressure signal to one side of the control piston for moving the control piston to move the control pin in the third direction thereof; in the second condition thereof, the reversing valve transmits the pressure signal to the opposite side of the control piston for moving the control piston to move the control pin in the opposite third direction thereof.

4. A device according to claim 3, further comprising an adjustment lever connected with the control pin for setting the position of the control pin as to the third and opposite third directions of movement thereof.

5. A device according to claim 3, wherein the double acting control piston is spring loaded to a neutral position with respect to the third and third opposite direction of movement thereof.

6. A device according to claim 3, wherein the servomotor includes a cylinder through which the servomotor first piston travels; the cylinder having a first chamber which, when pressurized, moves the first piston in the second direction thereof and having a second chamber which, when pressurized, moves the first piston in the second opposite direction;

the first piston shifting means including means for pressurizing the first chamber; the second piston shifting means including means for pressurizing the second chamber.

7. A device according to claim 1, wherein the servomotor includes a cylinder through which the servomotor first piston travels; the cylinder having a first chamber which, when pressurized, moves the first piston in the second direction thereof and having a second chamber which, when pressurized, moves the first piston in the second opposite direction;

the first piston shifting means including means for pressurizing the first chamber; the second piston shifting means including means for pressurizing the second chamber.

8. The device according to either of claims 7 or 3, wherein the wedge pathway of the wedge pathway member has a non-oblique section extending parallel to the motion of the first piston and that section being located intermediate the length of the wedge pathway and corresponding to a location in the pathway of movement of the push rod where the propeller blades have slight pitch displacement.

9. A device according to claim 3, wherein the load sensing and signal delivering means comprises a pressure converter between the engine and the reversing valve for intensifying the load signal received from the engine before transmitting that signal to the reversing valve.

10. A device according to claim 9, further comprising quantity control valves between the pressure converter and the reversing valve for adjusting the level of pressure transmitted to the reversing valve.

* * * * *